US010525743B2

(12) United States Patent
Ishikawa et al.

(10) Patent No.: US 10,525,743 B2
(45) Date of Patent: Jan. 7, 2020

(54) PRINTER

(71) Applicant: FUJITSU COMPONENT LIMITED, Tokyo (JP)

(72) Inventors: Tetsuhiro Ishikawa, Tokyo (JP); Masahiro Tsuchiya, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/996,762

(22) Filed: Jun. 4, 2018

(65) Prior Publication Data

US 2019/0030926 A1 Jan. 31, 2019

(30) Foreign Application Priority Data

Jul. 31, 2017 (JP) ..... 2017-148403

(51) Int. Cl.

| | |
|---|---|
| ***B41J 13/00*** | (2006.01) |
| ***B65H 16/02*** | (2006.01) |
| ***B41J 15/04*** | (2006.01) |
| ***B65H 26/08*** | (2006.01) |
| *B41J 2/32* | (2006.01) |
| *B41J 11/00* | (2006.01) |

(52) U.S. Cl.

CPC ..... *B41J 13/0009* (2013.01); *B41J 15/042* (2013.01); *B65H 16/028* (2013.01); *B65H 26/08* (2013.01); *B41J 2/32* (2013.01); *B41J 11/0075* (2013.01); *B65H 2301/41387* (2013.01); *B65H 2402/41* (2013.01); *B65H 2402/43* (2013.01); *B65H 2511/114* (2013.01); *B65H 2511/142* (2013.01); *B65H 2551/22* (2013.01); *B65H 2553/41* (2013.01); *B65H 2801/12* (2013.01)

(58) Field of Classification Search

CPC ..... B41J 15/042; B41J 11/0075; B41J 2/32; B41J 13/00; B41J 13/0009; B41J 15/00; B41J 15/046; B41J 15/04; B41J 15/044; B41J 5/04; B65H 16/028; B65H 2402/43; B65H 2402/41; B65H 2301/41387; B65H 2553/41; B65H 2551/22; B65H 2511/142; B65H 2511/114

See application file for complete search history.

(56) References Cited

U.S. PATENT DOCUMENTS

| | | | |
|---|---|---|---|
| 7,549,814 | B1 | 6/2009 | Arrington et al. |
| 2015/0053810 | A1 | 2/2015 | Chang et al. |

FOREIGN PATENT DOCUMENTS

| | | |
|---|---|---|
| CN | 104418143 | 3/2015 |
| EP | 0 649 808 | 4/1995 |
| EP | 2 514 599 | 10/2012 |
| JP | 5-89348 | 12/1993 |

(Continued)

OTHER PUBLICATIONS

Extended European Search Report dated Nov. 21, 2018 in Application No. 18175419.3.

(Continued)

*Primary Examiner* — Kristal Feggins
(74) *Attorney, Agent, or Firm* — Staas & Halsey LLP

(57) ABSTRACT

A printer includes: a holding member configured to hold a roll of paper; an elastic member configured to support the holding member so that the holding member is slidable in a vertical direction; a first detection unit configured to detect a position of the holding member; and a second detection unit that detects a near-end of the roll of paper based on a detection result by the first detection unit.

6 Claims, 7 Drawing Sheets

(56) References Cited

FOREIGN PATENT DOCUMENTS

| | | |
|---|---|---|
| JP | 2001-48379 | 2/2001 |
| JP | 2007-76849 | 3/2007 |

OTHER PUBLICATIONS

Japanese Platform for Patent Information English abstract for Japanese Patent Publication No. 2007-76849, published Mar. 29, 2007.

Japanese Platform for Patent Information English abstract for Japanese Patent Publication No. 2001-48379, published Feb. 20, 2001.

Espacenet English translation of Chinese Patent Pub. No. 104418143, published Mar. 18, 2015.

Chinese Office Action dated Sep. 29, 2019 in Application No. 201810780318.4.

FRONT ⟷ REAR

PRINTER

CROSS-REFERENCE TO RELATED APPLICATION

This application is based upon and claims the benefit of priority of the prior Japanese Patent Application No. 2017-148403 filed on Jul. 31, 2017, the entire contents of which are incorporated herein by reference.

FIELD

A certain aspect of the embodiments is related to a printer.

BACKGROUND

There has been conventionally known a sheet feeder having a function to detect the remaining amount of a roll of paper as disclosed in, for example, Japanese Patent Application Publication No. 2007-76849. Such a sheet feeder detects the remaining amount of a roll of paper by calculating a distance from a contact member that is in contact with the roll of paper to the bottom surface based on the rotation angle of a rotary switch.

In addition, a thermal printer having a thermal print unit is widely used as a mobile printer, an ATM, a KIOSK terminal, or a convenience store payment terminal printer. In the case where the administrator cannot reside and the timing for replacing a roll of paper is limited like ATM, implementation of a mechanism for detecting the state where the remaining amount of paper is small, that is, the so-called near-end of a roll of paper is desired.

There has been known a technique that detects the outside diameter of a roll of paper by attaching a switch or an optical sensor to the side surface or the bottom surface of a paper holder to detect the near-end of a roll of paper.

SUMMARY

According to an aspect of the present invention, there is provided a printer including: a holding member configured to hold a roll of paper; an elastic member configured to support the holding member so that the holding member is slidable in a vertical direction; a first detection unit configured to detect a position of the holding member; and a second detection unit that detects a near-end of the roll of paper based on a detection result by the first detection unit.

The object and advantages of the invention will be realized and attained by means of the elements and combinations particularly pointed out in the claims.

It is to be understood that both the foregoing general description and the following detailed description are exemplary and explanatory and are not restrictive of the invention, as claimed.

DESCRIPTION OF EMBODIMENTS

As the remaining amount of a roll of paper decreases, the outside diameter of the roll of paper increases due to loosening of the roll of paper. Thus, with the technique that detects the outside diameter of a roll of paper, the detection accuracy of the near-end of the roll of paper may decrease due to the increase in outside diameter of the roll of paper.

Hereinafter, embodiments of the present invention will be described with reference to the accompanying drawings.

Figure 1:
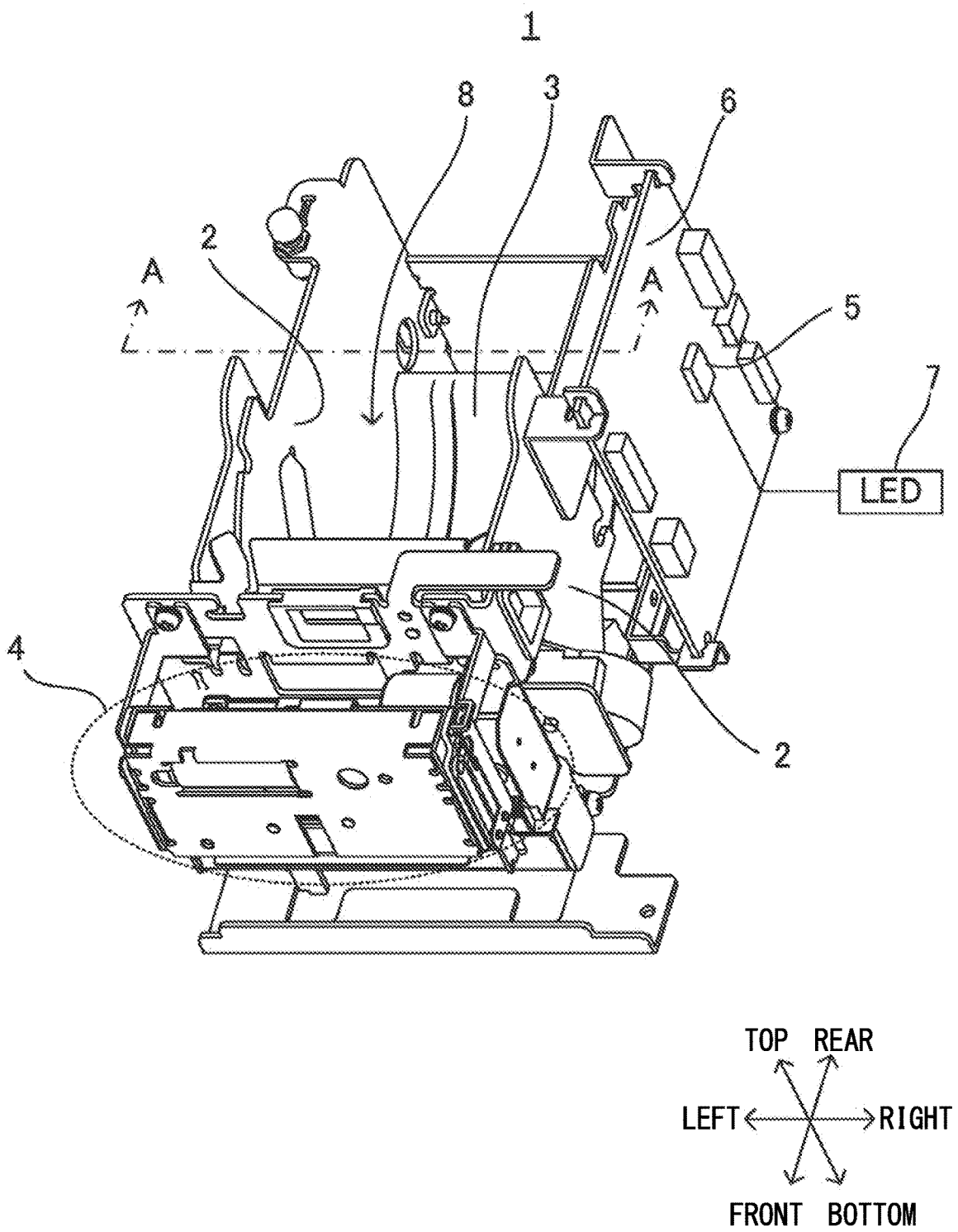
FIG. 1 is a perspective view of a printer in accordance with a present embodiment.
Figure 2A:
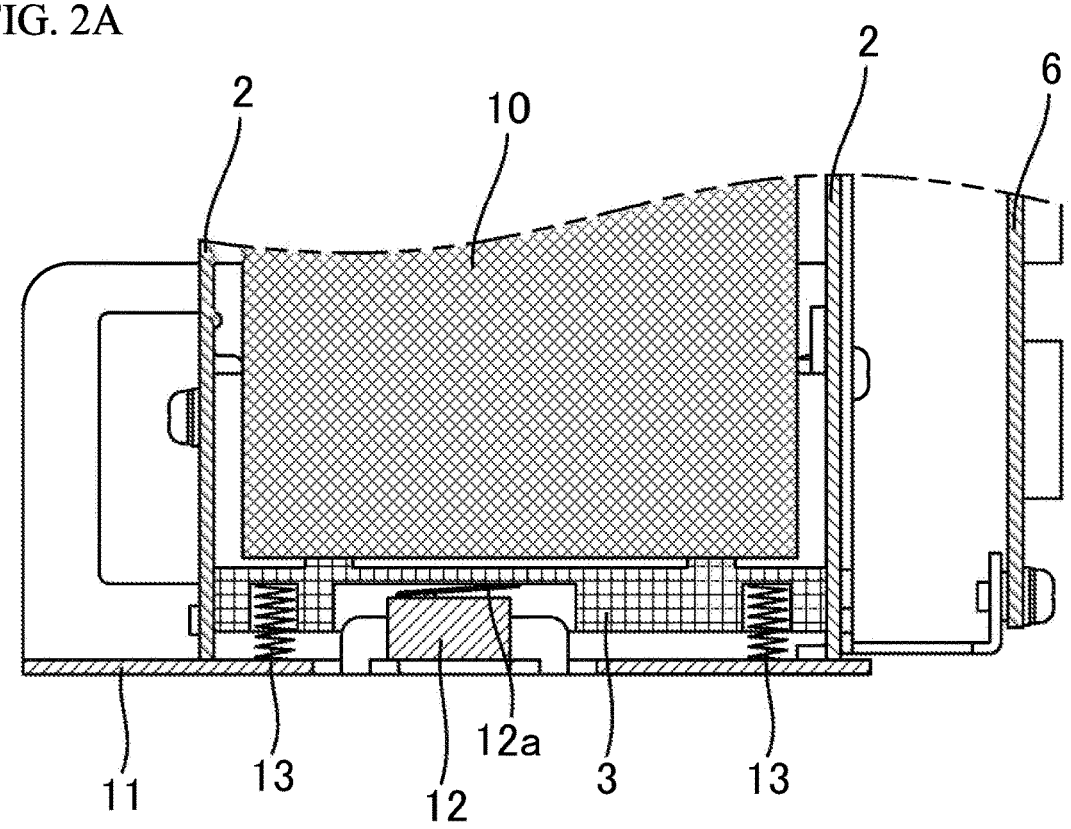
FIG. 2A is a partial cross-sectional view taken along line A-A in FIG. 1 when the remaining amount of a roll of paper is large.
Figure 2B:
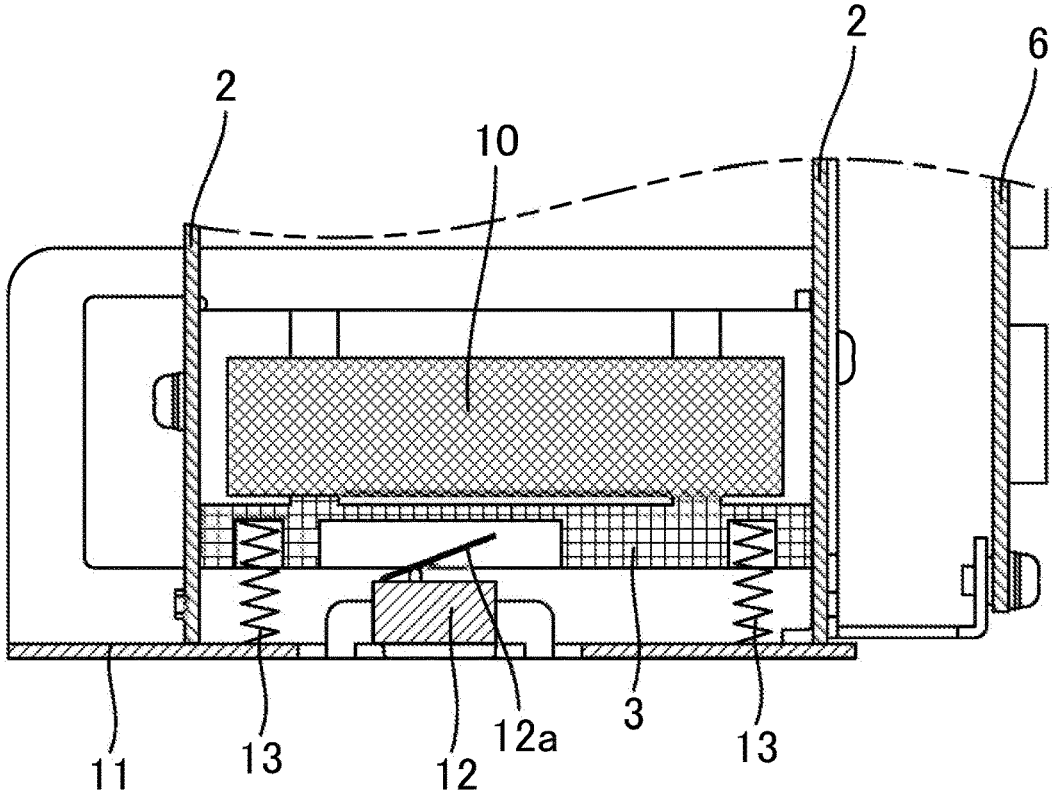
FIG. 2B is a partial cross-sectional view taken along line A-A in FIG. 1 when the remaining amount of a roll of paper is small.

FIG. 1 is a perspective view of a printer in accordance with a present embodiment. FIG. 2A is a cross-sectional view taken along line A-A in FIG. 1 when the remaining amount of a roll of paper is large. FIG. 2B is a cross-sectional view taken along line A-A in FIG. 1 when the remaining amount of a roll of paper is small. The front and rear, the top and bottom, and the right and left of the printer are defined as illustrated in FIG. 1.

A printer 1 illustrated in FIG. 1 is, for example, a thermal printer, and is installed in a mobile printer, an ATM, or a KIOSK terminal. The printer 1 includes: an outside holder 2 that regulates the movement of a roll of paper in the right-and-left direction and holds the roll of paper; an inside holder 3 as a holding member that is slidable relative to the outside holder 2 in the vertical direction and holds the roll of paper from below; a print unit 4 that includes a thermal head and a platen roller, which are not illustrated, and prints data on a roll of paper; a microcomputer 5 as a second detection unit that controls operations of the print unit 4 and receives signals from a mechanical switch or optical sensor described later; and a circuit board 6 having the microcomputer 5 mounted thereon and attached to the side surface of the outside holder 2. The microcomputer 5 is coupled to an LED 7, and when detecting the near-end of a roll of paper, notifies the user of the near-end of the roll of paper by lighting or blinking the LED 7. The near-end of a roll of paper indicates the state in which the remaining amount of the roll of paper is below a predetermined threshold value, and indicates the state in which replacement of the roll of paper is recommended.

A roll of paper falls in a space 8 surrounded by the outside holder 2 and the inside holder 3, and is then held along the curved shape of the inside holder 3, but a roll of paper may be held by a shaft penetrating through the center of the roll of paper. When a roll of paper is held by a shaft, both ends of the shaft is rotatably supported by the outside holder 2 or the inside holder 3. The structure of the printer 1 in FIG. 1 is merely an example, and does not intend to suggest any limitation.

FIG. 2A is a partial cross-sectional view taken along line A-A in FIG. 1 when the remaining amount of a roll of paper is large. FIG. 2B is a partial cross-sectional view taken along line A-A in FIG. 1 when the remaining amount of a roll of paper is small.

In FIG. 2A and FIG. 2B, the inside holder 3 is located on a bottom plate 11 of the printer 1 through springs 13 as elastic members. The springs 13 allow the inside holder 3 to slide in the vertical direction. The spring 13 is a coil spring, but may be a plate spring or a torsion coil spring. Alternatively, an elastic body such as rubber may be used instead of the spring 13. The outside holder 2 and the bottom plate 11 function as the chassis of the printer 1.

A mechanical switch 12 as a first detection unit is located under the inside holder 3 and on the bottom plate 11. The mechanical switch 12 is surrounded by the outside holder 2, the inside holder 3, and the bottom plate 11, thus being less affected by dust or the like. The mechanical switch 12 has a protrusion portion 12*a* that protrudes in one direction, and detects the position of the inside holder 3 in the vertical direction based on the up-and-down motion of the protrusion portion 12*a*.

In the case illustrated in FIG. 2A, as the remaining amount of a roll of paper 10 is large, the roll of paper 10 weighs down the inside holder 3, and the inside holder 3 thus compresses the springs 13. In this case, the bottom surface of the inside holder 3 is in contact with the protrusion portion 12*a* of the mechanical switch 12, and presses the protrusion portion 12*a* of the mechanical switch 12. When the protrusion portion 12*a* of the mechanical switch 12 is pressed, an ON signal is output from the mechanical switch 12 to the microcomputer 5. Accordingly, the microcomputer 5 determines that the remaining amount of the roll of paper 10 is large.

When the remaining amount of the roll of paper 10 is small as illustrated in FIG. 2B, the restoring force of the spring 13 lifts up the inside holder 3. In this case, the bottom surface of the inside holder 3 separates from the protrusion portion 12*a* of the mechanical switch 12, and the mechanical switch 12 is turned off. When the mechanical switch 12 is turned off, no signal is output from the mechanical switch 12 to the microcomputer 5. Accordingly, the microcomputer 5 determines that the remaining amount of the roll of paper 10 is small. That is, the microcomputer 5 is able to detect the near-end of a roll of paper. In this case, the microcomputer 5 lights or blinks the LED 7 to notify the user of the near-end of the roll of paper.

Figure 3A:
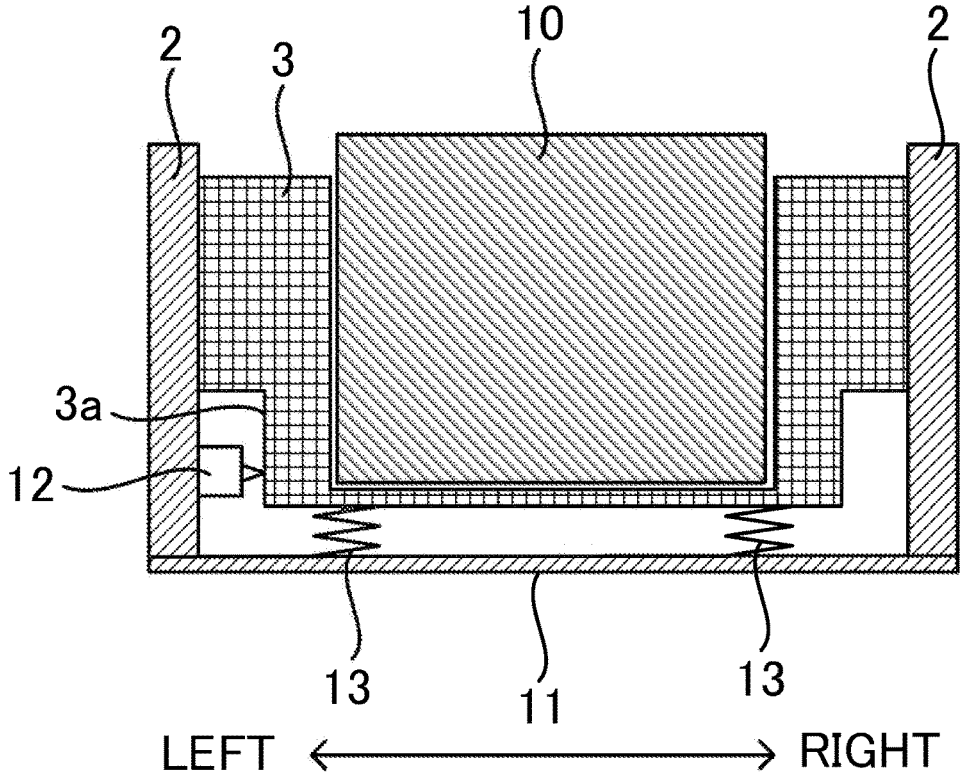
FIG. 3A illustrates a variation of the cross-section of the printer when the remaining amount of a roll of paper is large.
Figure 3B:
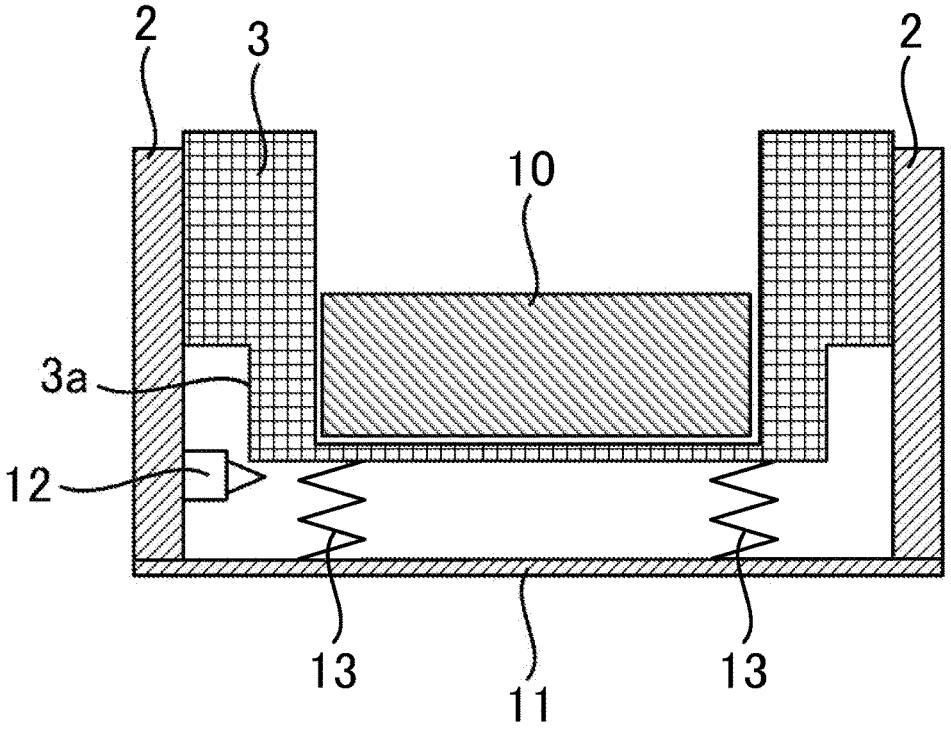
FIG. 3B illustrates a variation of the cross-section of the printer when the remaining amount of a roll of paper is small.

In FIG. 2A and FIG. 2B, the mechanical switch 12 is located under the inside holder 3 and on the bottom plate 11. However, the mechanical switch 12 may be arranged, for example, on the outside holder 2 (i.e., the side surface of the printer 1) as illustrated in FIG. 3A and FIG. 3B. In this case, as illustrated in FIG. 3A, when the remaining amount of a roll of paper is large, the roll of paper 10 weighs down the inside holder 3, the mechanical switch 12 is located between the outside holder 2 and a side surface 3*a* of the inside holder 3, and the mechanical switch 12 remains pressed. As illustrated in FIG. 3B, when the remaining amount of the roll of paper 10 is small, the restoring force of the spring 13 lifts up the inside holder 3, the side surface 3*a* of the inside holder 3 separates from the mechanical switch 12, and the mechanical switch 12 is turned off. FIG. 3A illustrates a variation of the cross-section of the printer 1 when the remaining amount of a roll of paper is large. FIG. 3B illustrates a variation of the cross-section of the printer 1 when the remaining amount of a roll of paper is small. FIG. 3A and FIG. 3B illustrate the cross-section taken along line A-A in FIG. 1.

The inside holder 3 may have a structure without lateral sides as illustrated in FIG. 2A and FIG. 2B, or a structure having lateral sides as illustrated in FIG. 3A and FIG. 3B. In FIG. 3A and FIG. 3B, the mechanical switch 12 is located on the outside holder 2 at the left side, but may be located on the outside holder 2 at the right side.

Figure 4A:
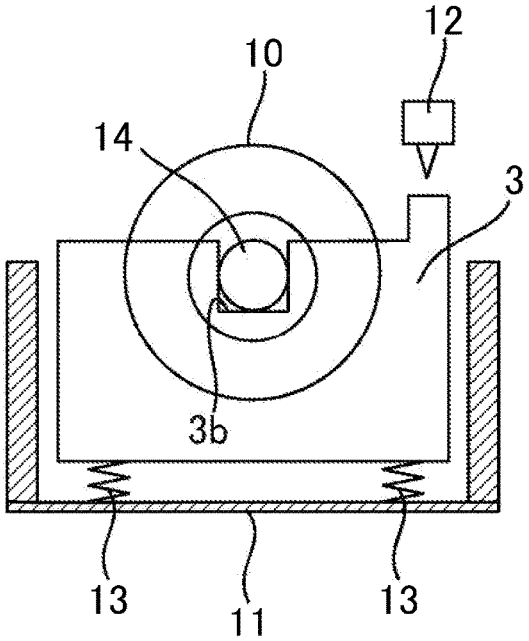
FIG. 4A illustrates another variation of the cross-section of the printer when the remaining amount of a roll of paper is large.
Figure 4B:
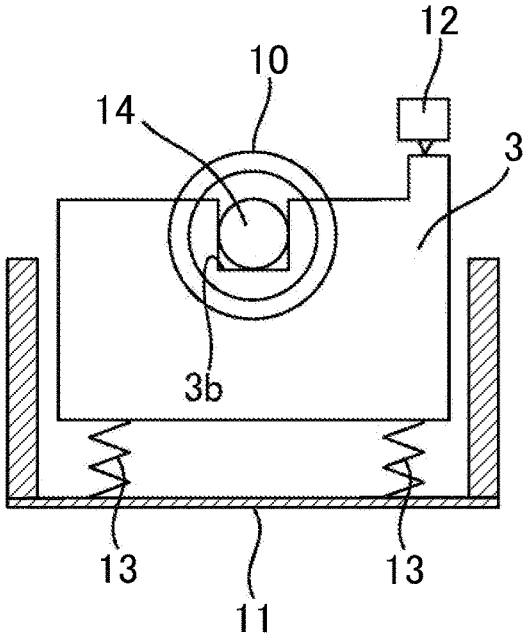
FIG. 4B illustrates another variation of the cross-section of the printer when the remaining amount of a roll of paper is small.

FIG. 4A illustrates another variation of the cross-section of the printer 1 when the remaining amount of a roll of paper is large. FIG. 4B illustrates another variation of the cross-section of the printer 1 when the remaining amount of a roll of paper is small. FIG. 4A and FIG. 4B illustrate the cross-section of the printer 1 as viewed from the right in FIG. 1.

In FIG. 4A and FIG. 4B, the roll of paper 10 is held by a shaft 14 penetrating through the center of the roll of paper 10, and both ends of the shaft 14 are rotatably supported by recess portions 3*b* of the inside holder 3. A roll of paper may be held along the curved shape of the inside holder 3 as illustrated in FIG. 1 without using the shaft 14.

In FIG. 4A and FIG. 4B, the mechanical switch 12 is located above the inside holder 3. As illustrated in FIG. 4A, when the remaining amount of a roll of paper is large, the roll of paper 10 weighs down the inside holder 3, and the inside holder 3 compresses the springs 13. Accordingly, the mechanical switch 12 faces the inside holder 3 while being apart from the inside holder 3, and the mechanical switch 12 is thus off. Thus, no signal is output from the mechanical switch 12 to the microcomputer 5. In this case, the microcomputer 5 determines that the remaining amount of the roll of paper 10 is large. As illustrated in FIG. 4B, when the remaining amount of the roll of paper 10 is small, the restoring force of the spring 13 lifts up the inside holder 3. In this case, a part of the upper surface of the inside holder 3 comes in contact with the mechanical switch 12, and presses the mechanical switch 12. When the mechanical switch 12 is pressed, an ON signal is output from the mechanical switch 12 to the microcomputer 5, and the microcomputer 5 determines that the remaining amount of the roll of paper 10 is small. The microcomputer 5 lights or blinks the LED 7 to notify the user of the near-end of the roll of paper.

Figure 5A:
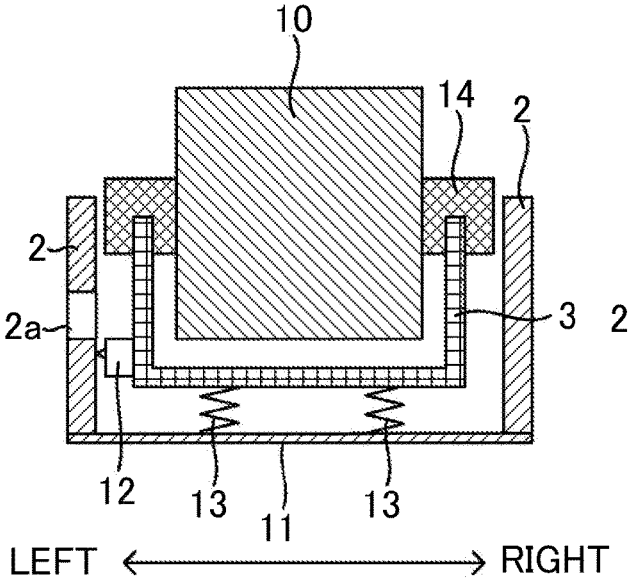
FIG. 5A and FIG. 5C illustrate other variations of the cross-section of the printer when the remaining amount of a roll of paper is large.
Figure 5B:
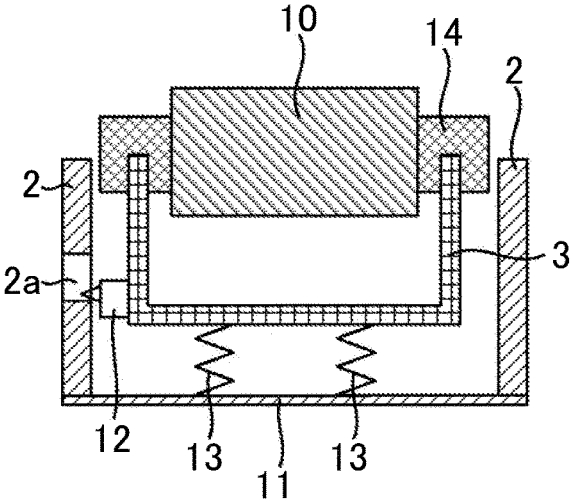
FIG. 5B and FIG. 5D illustrate other variations of the cross-section of the printer when the remaining amount of a roll of paper is small.
Figure 5C:
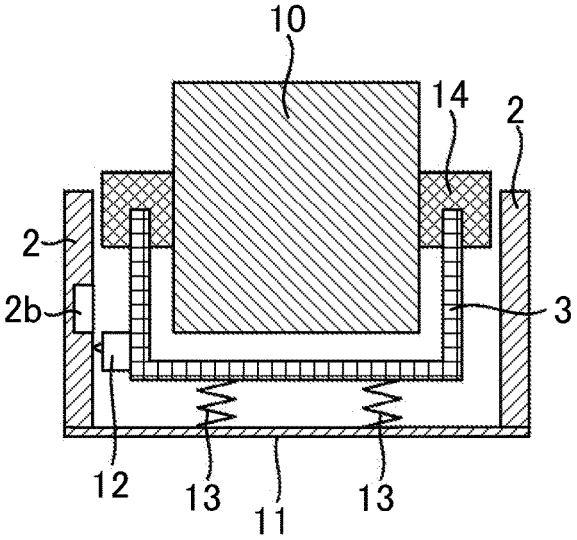
Figure 5D:
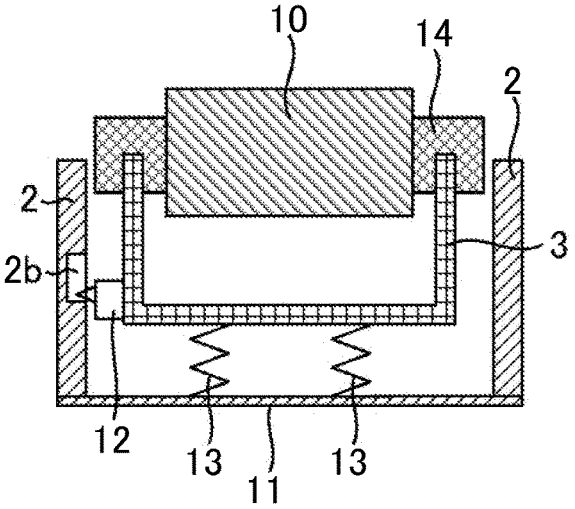

FIG. 5A and FIG. 5C illustrate other variations of the cross-section of the printer 1 when the remaining amount of a roll of paper is large. FIG. 5B and FIG. 5D illustrate other variations of the cross-section of the printer 1 when the remaining amount of a roll of paper is small. FIG. 5A through FIG. 5D illustrate the cross-section of the printer 1 as viewed from the front in FIG. 1.

In FIG. 5A through FIG. 5D, the mechanical switch 12 is located on the side surface, which faces the outside holder 2, of the inside holder 3. A penetration hole 2*a* illustrated in FIG. 5A and FIG. 5B or a recess portion 2*b* illustrated in FIG. 5C and FIG. 5D is formed in the outside holder 2. As illustrated in FIG. 5A and FIG. 5C, when the remaining amount of a roll of paper is large, the roll of paper 10 weighs down the inside holder 3, the mechanical switch 12 is located between the outside holder 2 and the side surface of the inside holder 3, and the mechanical switch 12 remains pressed. In this case, an ON signal is output from the mechanical switch 12 to the microcomputer 5, and the microcomputer 5 determines that the remaining amount of the roll of paper 10 is large.

As illustrated in FIG. 5B and FIG. 5D, as the remaining amount of the roll of paper 10 decreases, the restoring force of the spring 13 lifts up the inside holder 3, and the mechanical switch 12 gets into the penetration hole 2*a* or the recess portion 2*b* of the outside holder and is turned off. When the mechanical switch 12 is turned off, no signal is output from the mechanical switch 12 to the microcomputer 5. Thus, the microcomputer 5 determines that the remaining amount of the roll of paper 10 is small. The microcomputer 5 lights or blinks the LED 7 to notify the user of the near-end of a roll of paper.

Figure 6A:
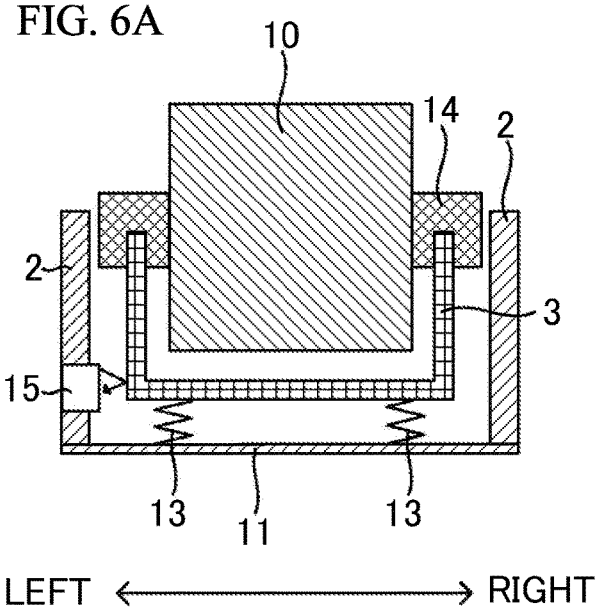
FIG. 6A and FIG. 6C illustrate yet other variations of the cross-section of the printer when the remaining amount of a roll of paper is large.
Figure 6B:
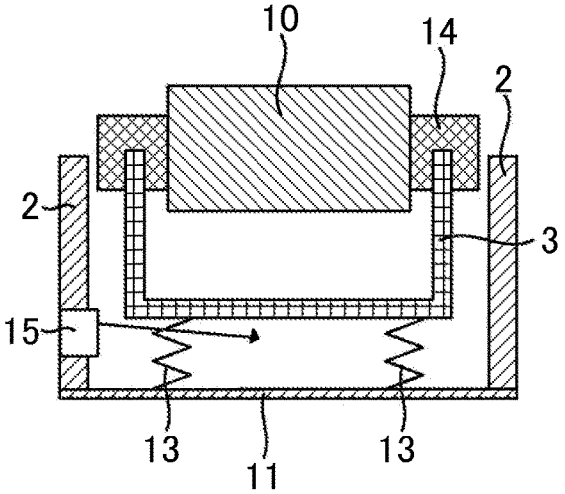
FIG. 6B and FIG. 6D illustrate yet other variations of the cross-section of the printer when the remaining amount of a roll of paper is small.
Figure 6C:
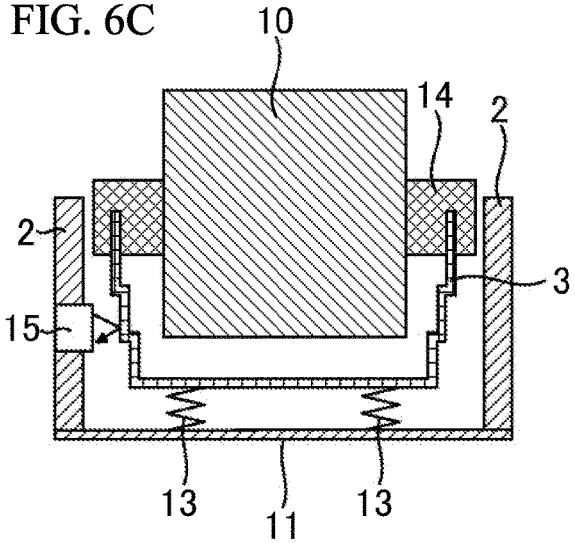
Figure 6D:
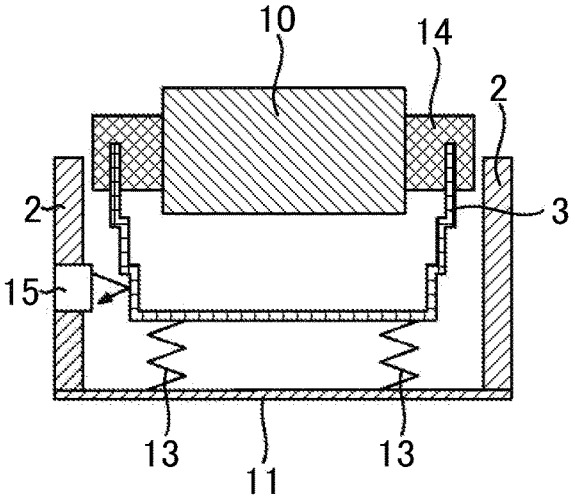

FIG. 6A and FIG. 6C are yet other variations of the cross-section of the printer 1 when the remaining amount of a roll of paper is large. FIG. 6B and FIG. 6D are yet other variations of the cross-section of the printer 1 when the remaining amount of a roll of paper is small. FIG. 6A through FIG. 6D illustrate the cross-section of the printer 1 as viewed from the front in FIG. 1.

In FIG. 6A through FIG. 6D, a reflective optical sensor 15 as the first detection unit is provided instead of the mechanical switch 12. The optical sensor 15 is located on the outside holder 2 toward the inside holder 3, and is electrically connected to the microcomputer 5.

The optical sensor 15 emits a light, receives a reflected light, and outputs a signal indicating the amount of light received to the microcomputer 5. When the distance between the optical sensor 15 and the inside holder 3 is short, the amount of light received is large. When the distance between the optical sensor 15 and the inside holder 3 is long, the amount of light received is small. Accordingly, when the amount of light received is equal to or greater than a threshold value, this means that the distance between the optical sensor 15 and the inside holder 3 is short and the inside holder 3 is weighed down with the roll of paper 10. Thus, the microcomputer 5 determines that the remaining amount of a roll of paper is large. When the amount of light received is less than the threshold value, this means that the distance between the optical sensor 15 and the inside holder 3 is long and the inside holder 3 is being lifted by the restoring force of the spring 13. Thus, the microcomputer 5 determines that the remaining amount of a roll of paper is small.

The microcomputer 5 may calculate the distance between the optical sensor 15 and the inside holder 3 based on a signal indicating the amount of light received. The microcomputer 5 may determine that the remaining amount of a roll of paper is large when the calculated distance is less than a threshold value, and determine that the remaining amount of a roll of paper is small when the calculated distance is equal to or greater than the threshold value.

As illustrated in FIG. 6A, when the remaining amount of a roll of paper is large, the roll of paper 10 weighs down the inside holder 3, the optical sensor 15 faces the inside holder 3, emits a light, receives a reflected light, and outputs a signal indicating the amount of light received to the microcomputer 5. In this case, the amount of light received by the optical sensor 15 is equal to or greater than the threshold value. Thus, the microcomputer 5 determines that the remaining amount of a roll of paper is large.

When the remaining amount of the roll of paper 10 is small as illustrated in FIG. 6B, the restoring force of the spring 13 lifts up the inside holder 3. In this case, the optical sensor 15 receives no reflected light or receives a reflected light from the outside holder 2 facing the optical sensor 15. Thus, the amount of light received by the optical sensor 15 is less than the threshold value. Accordingly, the microcomputer 5 determines that the remaining amount of the roll of paper 10 is small. The microcomputer 5 lights or blinks the LED 7, and notifies the user of the near-end of a roll of paper.

As illustrated in FIG. 6C and FIG. 6D, steps may be formed on the side surface of the inside holder 3. More specifically, steps may be formed on the side surface of the inside holder 3 so that the width in the horizontal direction increases from the bottom to the top of the side surface.

The step (position) of the inside holder 3 reflecting a light from the optical sensor 15 in FIG. 6C differs from that in FIG. 6D. In the case of FIG. 6C, since the distance between the optical sensor 15 and the inside holder 3 is less than that in FIG. 6D, the amount of light received is greater than that in FIG. 6D. Thus, by setting a threshold value at a value between the amount of light received in the case of FIG. 6C and the amount of light received in the case of FIG. 6D, the microcomputer 5 is able to appropriately determine whether the remaining amount of a roll of paper is large or small. In addition, by providing steps on the side surface of the inside holder 3 to change the reflection distance of a light from the optical sensor 15, the sensor level changes, and it becomes possible to detect the change in remaining amount of a roll of paper.

Figure 7A:
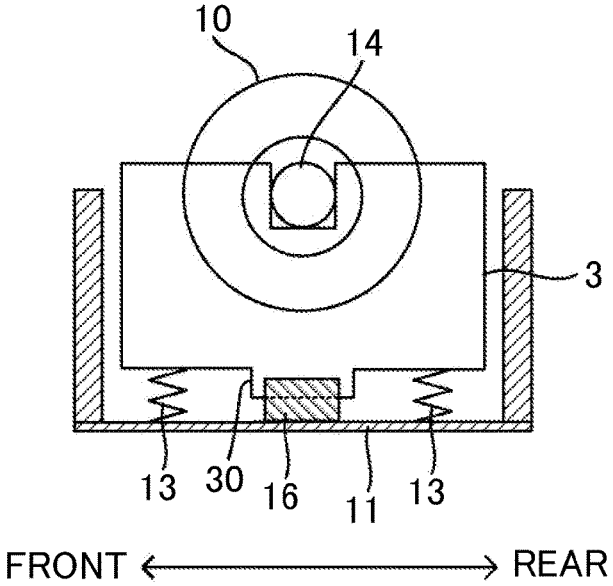
FIG. 7A is a cross-sectional view of the printer as viewed from the right in FIG. 1.
Figure 7B:
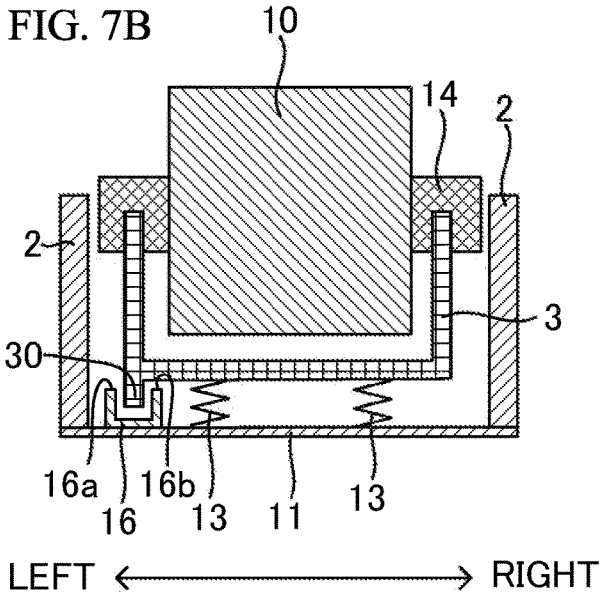
FIG. 7B illustrates yet another variation of the cross-section of the printer when the remaining amount of a roll of paper is large.
Figure 7C:
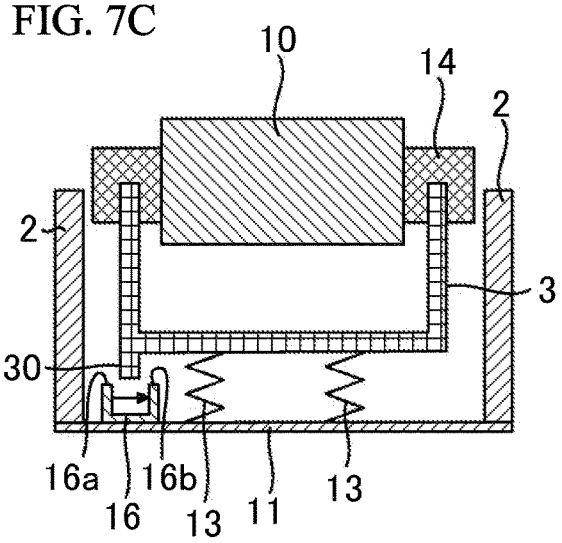
FIG. 7C illustrates yet another variation of the cross-section of the printer when the remaining amount of a roll of paper is small.

FIG. 7A is a cross-sectional view of the printer 1 as viewed from the right in FIG. 1. FIG. 7B illustrates yet another variation of the cross-section of the printer 1 when the remaining amount of a roll of paper is large. FIG. 7C illustrates yet another variation of the cross-section of the printer 1 when the remaining amount of a roll of paper is small. FIG. 7B and FIG. 7C illustrate the cross-section of the printer 1 as viewed from the front in FIG. 1.

As illustrated in FIG. 7A through FIG. 7C, a transmissive optical sensor 16 is located on the bottom plate 11. The optical sensor 16 is electrically connected to the microcomputer 5. The optical sensor 16 includes a light-emitting unit 16*a* that emits a light and a light-receiving unit 16*b* that receives the light emitted from the light-emitting unit 16*a*. When receiving a light from the light-emitting unit 16*a* within a predetermined time period from the light emission, the light-receiving unit 16*b* outputs an ON signal to the microcomputer 5, and when not receiving a light from the light-emitting unit 16*a* within the predetermined time period from the light emission, outputs an OFF signal to the microcomputer 5.

As illustrated in FIG. 7A, a protrusion portion 30 protruding downward is formed at the lower end of the inside holder 3. As illustrated in FIG. 7B, the protrusion portion 30 is configured so as to be located between the light-emitting unit 16*a* and the light-receiving unit 16*b* when the remaining amount of a roll of paper is large.

As illustrated in FIG. 7B, when the remaining amount of a roll of paper is large, the roll of paper 10 weighs down the inside holder 3, and the light-emitting unit 16*a* of the optical sensor 16 emits a light. Since the protrusion portion 30 is located between the light-emitting unit 16*a* and the light-receiving unit 16*b* and blocks the light from the light-emitting unit 16*a*, the light-receiving unit 16*b* does not receive the light from the light-emitting unit 16*a* and thus outputs an OFF signal to the microcomputer 5. The microcomputer 5 determines that the remaining amount of a roll of paper is large based on the off signal from the light-receiving unit 16*b*.

As illustrated in FIG. 7C, when the remaining amount of the roll of paper 10 is small, the restoring force of the spring 13 lifts up the inside holder 3 and the protrusion portion 30. In this case, the protrusion portion 30 does not block a light from the light-emitting unit 16*a*, and the light-receiving unit 16*b* receives the light from the light-emitting unit 16*a* and outputs an ON signal to the microcomputer 5. The microcomputer 5 determines that the remaining amount of a roll of paper is small based on the ON signal from the light-receiving unit 16*b*. The microcomputer 5 lights or blinks the LED 7, and notifies the user of the near-end of a roll of paper.

As described above, the printer 1 includes the inside holder 3 holding the roll of paper 10, the spring 13 supporting the inside holder 3 so that the inside holder 3 is slidable in the vertical direction, the mechanical switch 12 that detects whether the mechanical switch 12 is in contact with the inside holder 3, and the microcomputer 5 that detects the near-end of the roll of paper 10 based on the detection result by the mechanical switch 12. Accordingly, unlike the conventional technique, the near-end of the roll of paper 10 is detected based on the contact position or non-contact position with the inside holder 3 by the mechanical switch 12 without detecting the outside diameter of the roll of paper 10. Therefore, regardless of the state of the outside diameter of the roll of paper 10, the detection accuracy of the near-end of the roll of paper 10 is improved.

The printer 1 includes the inside holder 3 that holds the roll of paper 10, the spring 13 that supports the inside holder 3 so that the inside holder 3 is slidable in the vertical direction, the optical sensor 15 that emits a light to the inside holder 3 and detects the amount of received reflected light by the inside holder 3, and the microcomputer 5 that detects the near-end of the roll of paper 10 based on the detection result by the optical sensor 15. Accordingly, unlike the conventional technique, the near-end of the roll of paper 10 is detected based on the amount of light received by the optical sensor 15 without detecting the outside diameter of the roll of paper 10. Therefore, regardless of the state of the outside diameter of the roll of paper 10, the detection accuracy of the near-end of the roll of paper 10 is improved.

Furthermore, in the present embodiment, none of the mechanical switch 12 and the optical sensors 15 and 16 is in direct contact with the roll of paper 10. Thus, scratching or folding of the roll of paper 10 is prevented.

The present embodiment uses the LED 7 for notification of the near-end, but the notification of the near-end may be executed by other methods. For example, notification of the near-end may be performed by data communication to a superior device connected to the printer 1.

All examples and conditional language recited herein are intended for pedagogical purposes to aid the reader in understanding the invention and the concepts contributed by the inventor to furthering the art, and are to be construed as being without limitation to such specifically recited examples and conditions, nor does the organization of such examples in the specification relate to a showing of the superiority and inferiority of the invention. Although the embodiments of the present invention have been described in detail, it should be understood that the various change, substitutions, and alterations could be made hereto without departing from the spirit and scope of the invention.

What is claimed is:

1. A printer comprising:

a holding member configured to hold a roll of paper, be slidably supported in a vertical direction by an elastic member, and a position of the holding member is moved according to a weight of the roll of paper;

a first detector configured to detect the position of the holding member; and a second detector configured to detect a near-end of the roll of paper based on a detection result by the first detector.

2. The printer according to claim 1, wherein the first detector is located above the holding member, under the holding member, or at a location facing a side surface of the holding member.

3. The printer according to claim 1, further comprising a chassis configured to hold the holding member through the elastic member, wherein the first detector is located on a side surface, which faces the chassis, of the holding member, and the chassis has a penetration hole or a recess portion at a position facing a position at which the first detector is located when the second detector detects a near-end of the roll of paper.

4. The printer according to claim 1, wherein a side surface, which faces the first detector, of the holding member has a step that makes a width of the holding member in a horizontal direction increase toward a bottom or a top.

5. The printer according to claim 1, wherein the first detector includes a protrusion portion protruding in one direction, and detects a position of the holding member in the vertical direction by the protrusion portion.

6. The printer according to claim 1, wherein the first detector detects the position of the holding member based on one of contact or non-contact with the holding member.

* * * * *